US009364105B2

(12) United States Patent
Malcolm et al.

(10) Patent No.: US 9,364,105 B2
(45) Date of Patent: Jun. 14, 2016

(54) DISH ASSEMBLY FOR DISPLAYING AN IMAGE

(71) Applicants: Carter T. Malcolm, Ann Arbor, MI (US); Jacqueline K. Malcolm, Ann Arbor, MI (US)

(72) Inventors: Carter T. Malcolm, Ann Arbor, MI (US); Jacqueline K. Malcolm, Ann Arbor, MI (US)

( * ) Notice: Subject to any disclaimer, the term of this patent is extended or adjusted under 35 U.S.C. 154(b) by 0 days.

(21) Appl. No.: 13/941,074

(22) Filed: Jul. 12, 2013

(65) Prior Publication Data

US 2015/0014330 A1 Jan. 15, 2015

(51) Int. Cl.

| | |
|---|---|
| ***A47G 19/00*** | (2006.01) |
| ***A47G 21/00*** | (2006.01) |
| ***A47G 23/00*** | (2006.01) |
| ***A47G 19/02*** | (2006.01) |

(52) U.S. Cl.

CPC ..... *A47G 19/025* (2013.01)

(58) Field of Classification Search

CPC ..... A47G 19/025
USPC ..... 220/495.03, 574, 751, 556; 40/760, 734
See application file for complete search history.

(56) References Cited

U.S. PATENT DOCUMENTS

| | | | | | |
|---|---|---|---|---|---|
| D109,980 | S | * | 6/1938 | Guild | D7/584 |
| 2,514,094 | A | * | 7/1950 | Rubin | 220/574.2 |
| D175,072 | S | * | 7/1955 | Guild | D7/558 |
| 2,861,367 | A | * | 11/1958 | Chanslor | 40/324 |
| D195,475 | S | * | 6/1963 | Swett | D7/630 |
| 3,190,486 | A | * | 6/1965 | Rech | 220/574 |
| 3,514,887 | A | * | 6/1970 | Jacob | 40/324 |
| 4,141,162 | A | * | 2/1979 | Mascolo | 40/536 |
| 4,330,060 | A | * | 5/1982 | Thornton | 206/459.5 |
| 4,908,066 | A | * | 3/1990 | Taylor et al. | 108/26 |
| 4,936,462 | A | * | 6/1990 | Yuen | 206/542 |
| 5,158,202 | A | * | 10/1992 | Kosonen et al. | 220/574 |
| 5,292,028 | A | * | 3/1994 | Patterson et al. | 220/574 |
| 5,560,653 | A | * | 10/1996 | Beppu | 283/117 |
| 5,787,625 | A | * | 8/1998 | Yesbick | 40/718 |
| 6,082,033 | A | * | 7/2000 | Skinner | 40/750 |
| 6,098,831 | A | * | 8/2000 | Dibble | 220/574 |
| D439,058 | S | * | 3/2001 | Freiberg | D6/314 |
| D522,355 | S | * | 6/2006 | Castellanos et al. | D9/425 |
| 7,086,580 | B2 | * | 8/2006 | Liou | 229/407 |
| 7,249,686 | B1 | * | 7/2007 | Aesquivel | 220/556 |
| 7,588,162 | B2 | * | 9/2009 | Dube et al. | 220/552 |
| 7,637,388 | B2 | * | 12/2009 | Schantz et al. | 220/574.1 |
| 7,673,750 | B1 | * | 3/2010 | Huckert | 206/459.1 |
| D636,611 | S | * | 4/2011 | Duma | D6/309 |
| D638,262 | S | * | 5/2011 | Eberstadt et al. | D7/554.2 |
| 8,047,397 | B2 | * | 11/2011 | Mittet | 220/751 |
| 8,146,280 | B2 | * | 4/2012 | Mehler | 40/786 |
| 8,328,034 | B2 | * | 12/2012 | Miros et al. | 220/4.22 |
| D679,952 | S | * | 4/2013 | Holding et al. | D7/550.1 |
| 8,459,490 | B1 | * | 6/2013 | McTaggart | 220/574 |
| D690,076 | S | * | 9/2013 | LeStage et al. | D1/105 |
| D701,732 | S | * | 4/2014 | Ehrenhaus | D7/539 |

(Continued)

*Primary Examiner* — Nathan J Newhouse
*Assistant Examiner* — Jennifer N Zettl
(74) *Attorney, Agent, or Firm* — Brinks Gilson & Lione

(57) ABSTRACT

A vessel assembly for displaying an image includes a vessel having a first side and a second side. At least a portion of the vessel is at least partially transparent. A plurality of brackets are coupled to the second side of the vessel. The plurality of brackets are configured to stabilize the vessel on a surface. A plurality of brackets are configured to detachably return a support base to the vessel. The support base is configured to retain an image between the support base and the second side of the vessel to allow the image to be viewed through the portion of the vessel that is at least partially transparent.

12 Claims, 4 Drawing Sheets

(56) References Cited

U.S. PATENT DOCUMENTS

| | | | | |
|---|---|---|---|---|
| D706,082 | S * | 6/2014 | Malcolm et al. | D7/558 |
| 8,769,849 | B1 * | 7/2014 | McCombs | 40/324 |
| 8,794,686 | B2 * | 8/2014 | Grieve | 294/172 |
| D716,003 | S * | 10/2014 | Brown | D30/129 |
| 8,881,905 | B2 * | 11/2014 | Sarnoff et al. | 206/541 |
| 8,887,918 | B2 * | 11/2014 | Parsons | 206/546 |
| 2002/0079317 | A1 * | 6/2002 | Scott | 220/574 |
| 2002/0096528 | A1 * | 7/2002 | Fernandez | 220/574 |
| 2003/0150865 | A1 * | 8/2003 | Bergkvist | 220/574 |
| 2004/0031807 | A1 * | 2/2004 | Chou | 220/786 |
| 2004/0084464 | A1 * | 5/2004 | Koo | 220/784 |
| 2005/0139601 | A1 * | 6/2005 | Thum | 220/574 |
| 2006/0248769 | A1 * | 11/2006 | Rose | 40/734 |
| 2006/0249522 | A1 * | 11/2006 | Ringo | 220/784 |
| 2007/0151977 | A1 * | 7/2007 | Casale | 220/574 |
| 2012/0285060 | A1 * | 11/2012 | Gross et al. | 40/711 |
| 2012/0311905 | A1 * | 12/2012 | Dodd et al. | 40/798 |
| 2013/0249471 | A1 * | 9/2013 | Kim et al. | 320/107 |
| 2014/0166667 | A1 * | 6/2014 | Cameron | 220/574 |
| 2014/0358718 | A1 * | 12/2014 | Casey | 705/26.5 |

* cited by examiner

DISH ASSEMBLY FOR DISPLAYING AN IMAGE

BACKGROUND

1. Field of the Invention

The invention relates to vessels for presenting food and more specifically to vessels for presenting food to children.

2. Description of the Known Art

Vessels for serving food are known in the art. These vessels can include plates, bowls, glasses, cups, mugs, or any other device as designed to temporarily carry food and provide it for a person to ingest. Additionally, there have been a number of vessels that are designed specifically for temporarily holding food that is to be served to children. Typically, these vessels are similar to those described above but may be made generally smaller in size to accommodate the smaller stature of children.

Additionally, these vessels that are specifically designed for children may have a variety of different designs or images fixed on the serving vessels to provide entertainment for children. However, as these designs and images are static in nature, the effect of the designs meant to entertain children become less and less over time, as children become more familiar with these designs.

SUMMARY

A vessel assembly for displaying an image includes a vessel having a first side and a second side, where at least a portion of the vessel is at least partially transparent. The vessel may be flat or may be concave in shape and may be a plate, dish, bowl, cup, mug, or the like.

A plurality of brackets are coupled to the second side of the vessel. The plurality of brackets are configured to stabilize the vessel on the surface, such as a table, and are configured to detachably retain the support base to the vessel. The support base is configured to retain an image between the support base and the second side of the vessel to allow the image to be viewed through a portion of the vessel that is partially transparent.

The support base may further include a first side and a second side, wherein the first side contains a cavity for retaining the image. The cavity may also include a cutout portion for allowing the image to be easily removed from the cavity. In like manner, the second side of the support base may also include a cavity for retaining an image as well as a cutout for allowing the image to be easily removed from the second cavity.

The plurality of brackets may include a first bracket, a second bracket, and a third bracket. The first bracket, second bracket, and third bracket may be substantially equal distance from each other on the second side of the vessel. The first bracket, second bracket, and third bracket may be made of a semi-rigid material for allowing removal or insertion of the support plate by flexing the support brackets when inserting or removing the support plate. Further, an edging may be located on the second side of the vessel extending between the first bracket and the second bracket and the third bracket. However, the edging may only partially extend from the third bracket to the first bracket to define an opening between the edging and the first bracket.

The base plate may further include a handle. When retained by the brackets, the handle may extend through the opening between the edging and the first bracket. The handle may be adjacent to the first bracket when the base plate is retained by the plurality of brackets.

Further objects, features and advantages of this invention will become readily apparent to persons skilled in the art after a review of the following description, with reference to the drawings and claims that are appended to and form a part of this specification.

DETAILED DESCRIPTION

Figure 1:
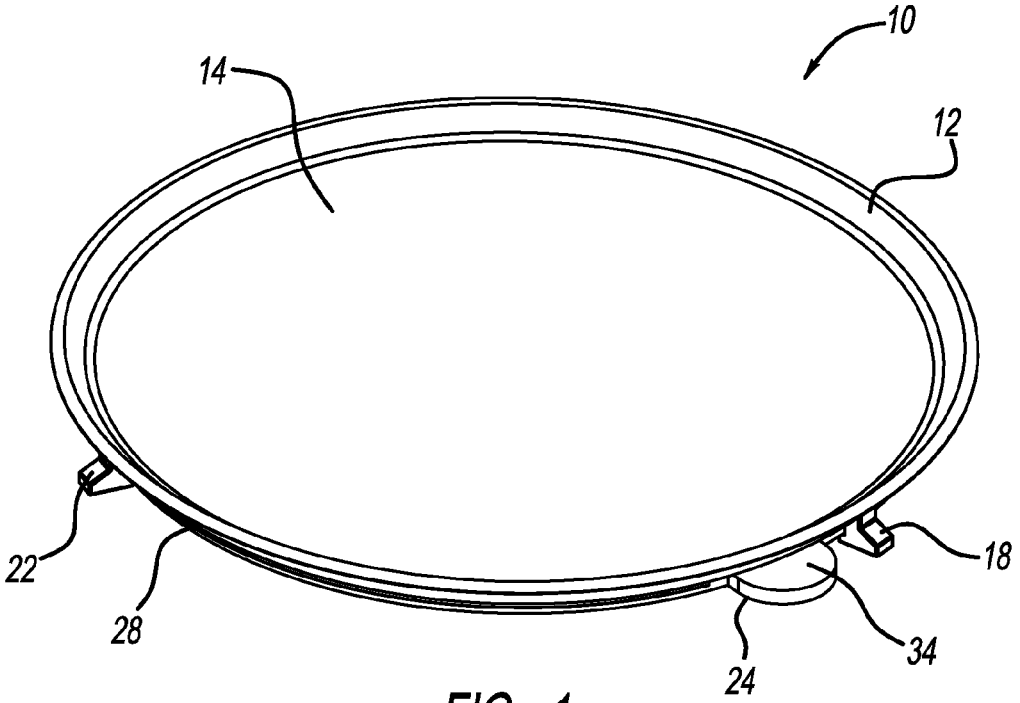
FIG. 1 illustrates a vessel assembly.

Referring to FIGS. 1-4, a vessel assembly 10 is shown. As its primary components, the vessel assembly includes a vessel 12 having a top side 14 and a bottom side 16. At least a portion of the vessel 12 may be partially transparent. In this embodiment, the entire vessel 12 is transparent; however, as stated before, only a portion of the vessel 12 may be transparent or partially transparent. The vessel 12 may be any one of a number of different items configured to serve food to a person. For example, the vessel 12 may be a plate (as shown), a bowl, a dish, a glass, cup, mug, or the like.

The vessel 12 may be made of any one of a number of different materials such as metal, wood, plastic, or glass. Generally, the transparent portions of the vessel 12 would be made of a transparent plastic or transparent glass. The vessel 12 may have a substantially circular shape but may take any one of a variety of different shapes such as a rectangle or triangular-type shape or any other suitable shape. Further, the transparent portions of the vessel 12 may be a clear transparency or may be any number of transparent or partially transparent colors.

A plurality of brackets including a first bracket 18, a second bracket 20, and a third bracket 22 are coupled to the second side 16 of the vessel 12. The plurality of brackets may be configured to stabilize the vessel on a flat surface, such as a table. The plurality of brackets are also configured to detachably retain a support base 24 to the vessel assembly 10. The support base 24 is configured to retain an image between the support base 24 and the second side 16 of the vessel 12 for allowing the image to be viewed through a portion of the vessel 12 as at least partially transparent.

The first bracket 18, second bracket 20 and third bracket 22 are generally made of a semi-rigid material such as a semi-rigid plastic material. The first bracket 18, second bracket 20, and third bracket 22 are generally substantially equal distance from each other on the second side 16 of the vessel 12.

Figure 5:
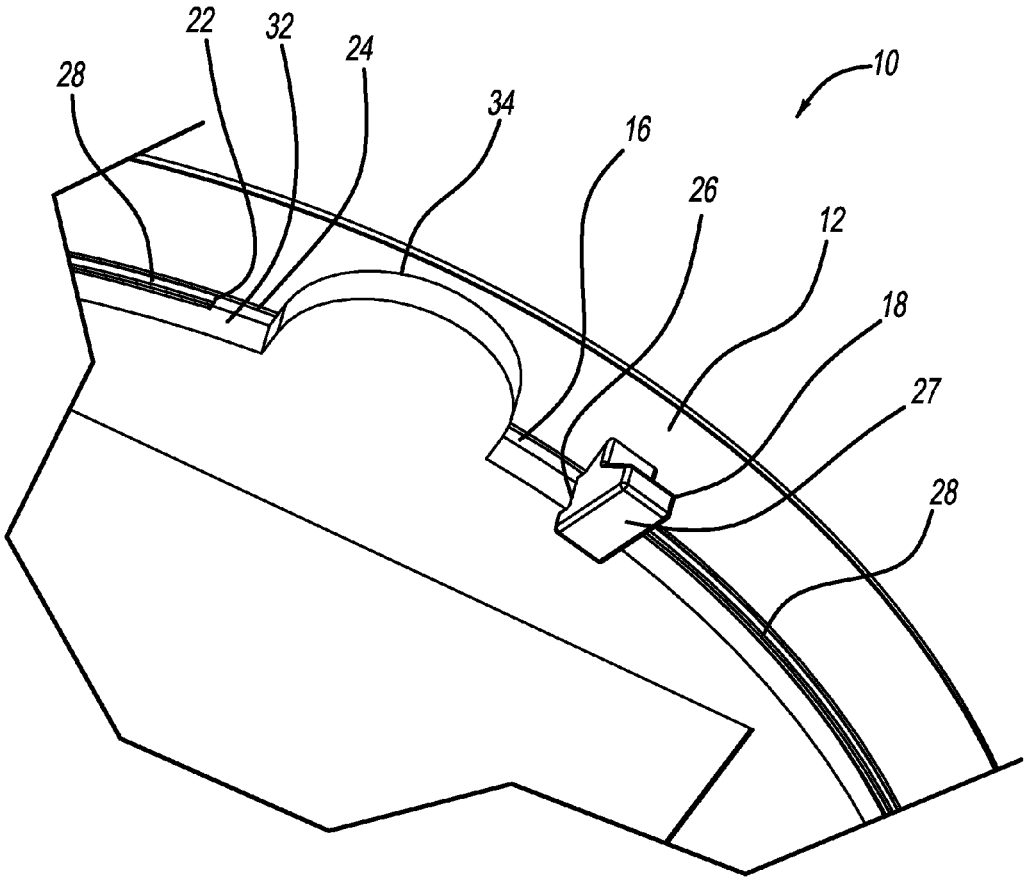
FIG. 5 illustrates a more detailed view of the vessel and bracket of FIG. 4.

Referring to FIG. 5, a more detailed view of the first bracket 18 is shown. It should be understood that any description given to the first bracket is equally applicable to the second bracket 20 and third bracket 22 unless specifically noted. The first bracket 18 may includes a small lip portion 26 which is configured to accommodate the perimeter 28 of the support plate 24. Essentially, the first bracket 18, second bracket 20, and third bracket 22 each have a lip 26 that retains a portion of the perimeter 28 of the support plate 24 towards the second side 16 of the vessel 12. Any images that are located between the support plate 24 and vessel 12 can then be displayed through any transparent portions of the vessel 12.

The brackets the first bracket 18, second bracket 20, and third bracket 22 may each also have a flat portion 27 that may define a surface that is substantially parallel the a surface defined by the first side 14 of the vessel 12. The flat portion 27 may assist with stabilizing the vessel assembly 10 on a flat surface, such as a table.

Figure 2:
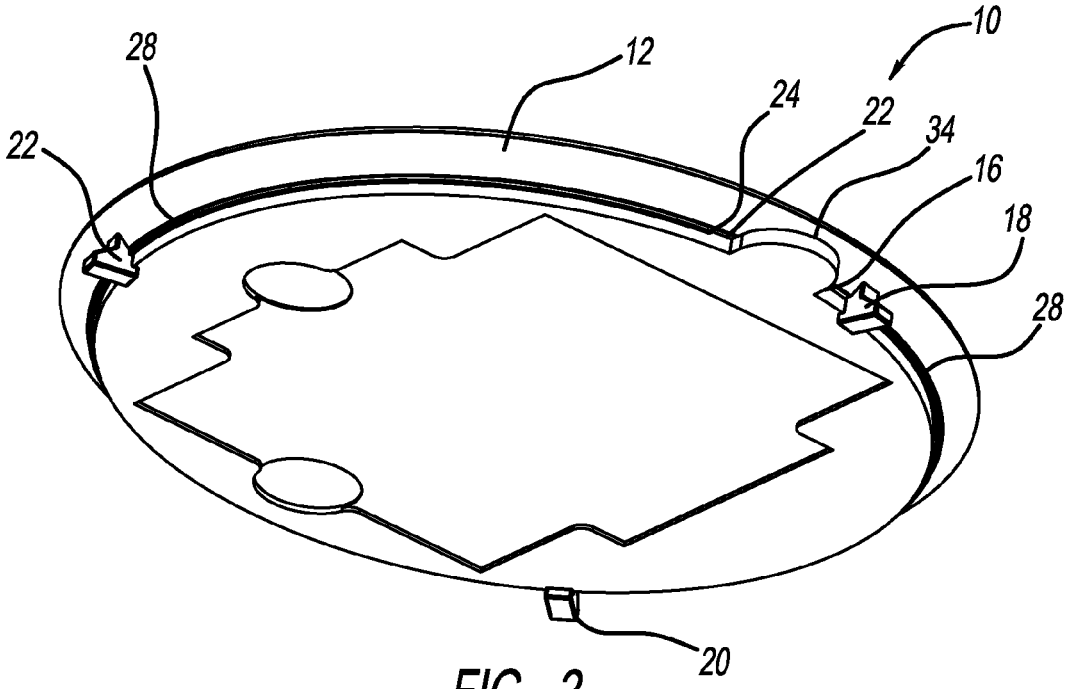
FIG. 2 illustrates a bottom side of the vessel assembly of FIG. 1.
Figure 3:
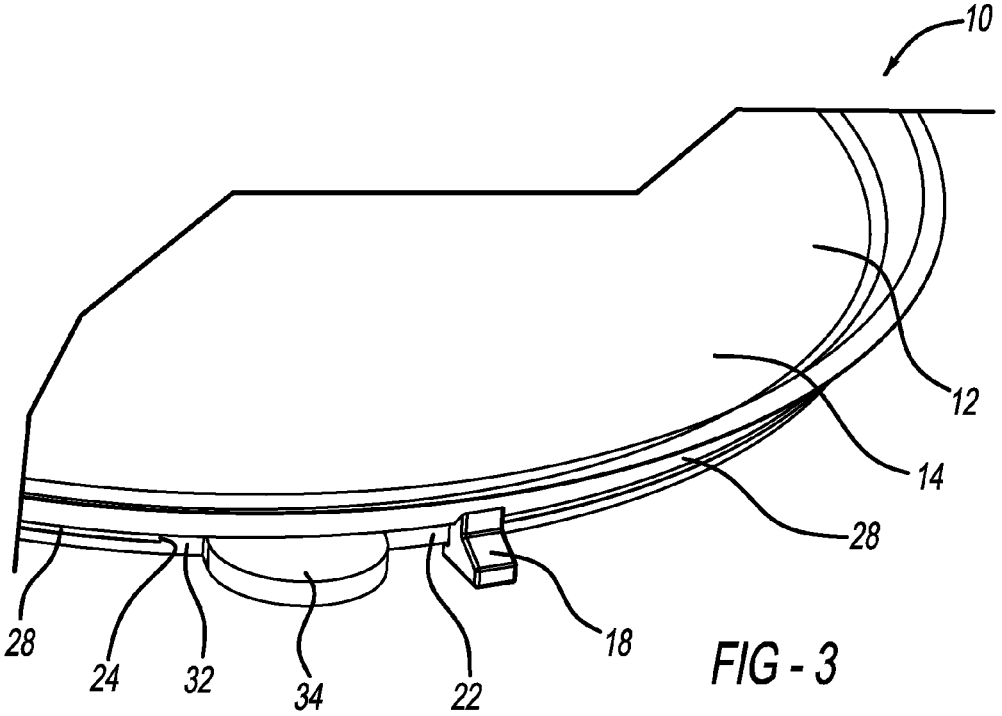
FIG. 3 illustrates a more detailed view of the vessel near a bracket.
Figure 4:
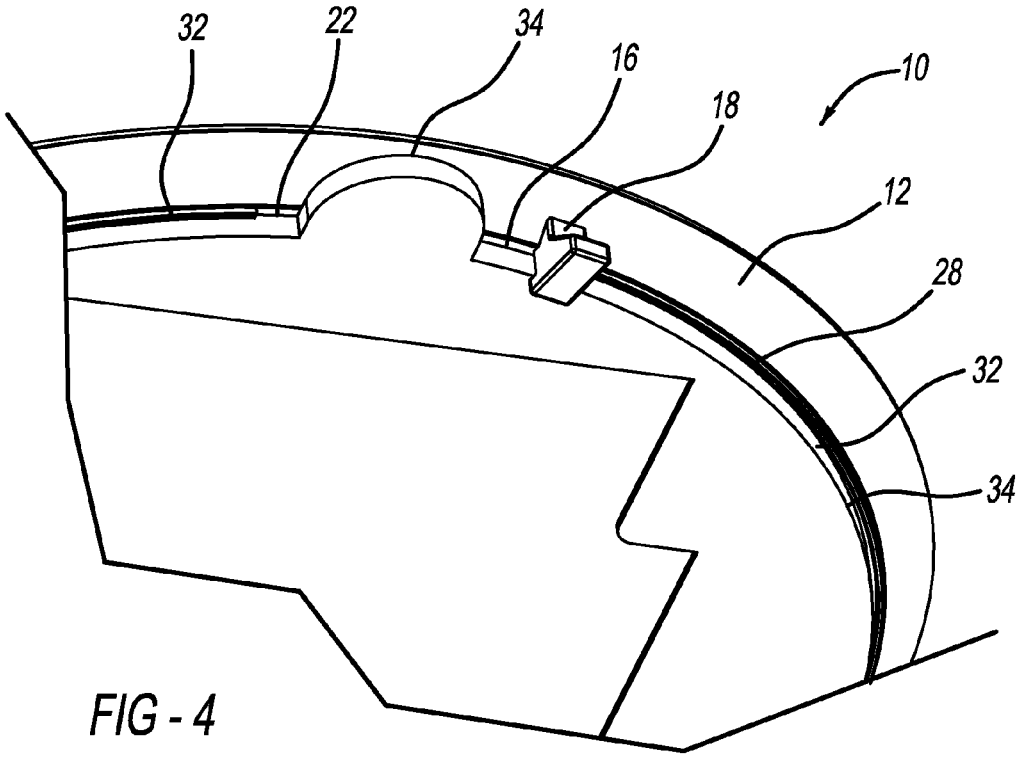
FIG. 4 illustrates a bottom side of the vessel illustrated in FIG. 3.

Referring to FIG. 2, an edging 28 may be located between and extend from the first bracket 18 to the second bracket 20. This edging may continue to extend from the second bracket 20 and third bracket 22. Finally, this edging may extend from the third bracket 22 towards to first bracket 18 but not touch the first bracket 18 thereby creating the opening 32.

The opening 32 can allow a handle 34 of the base plate 24 to protrude therefrom through the opening 32. This also has the additional advantage that it allows the user to easily remove the base plate 24 from the second side 16 of the vessel 12. Essentially, a user can use a combination of their finger and thumb, wherein either the finger or thumb is located on the handle 34 or the bracket 20 to allow the base plate 24 to be easily popped out of the retaining brackets 18, 20, and 22.

Figure 6:
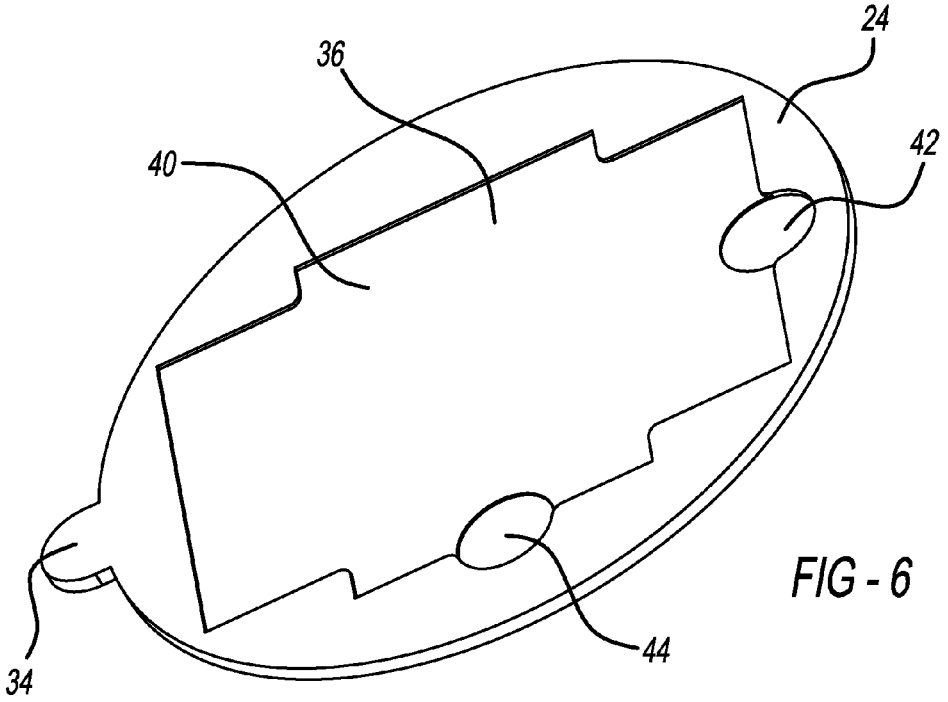
FIG. 6 Illustrates a first side of a support base.
Figure 7:
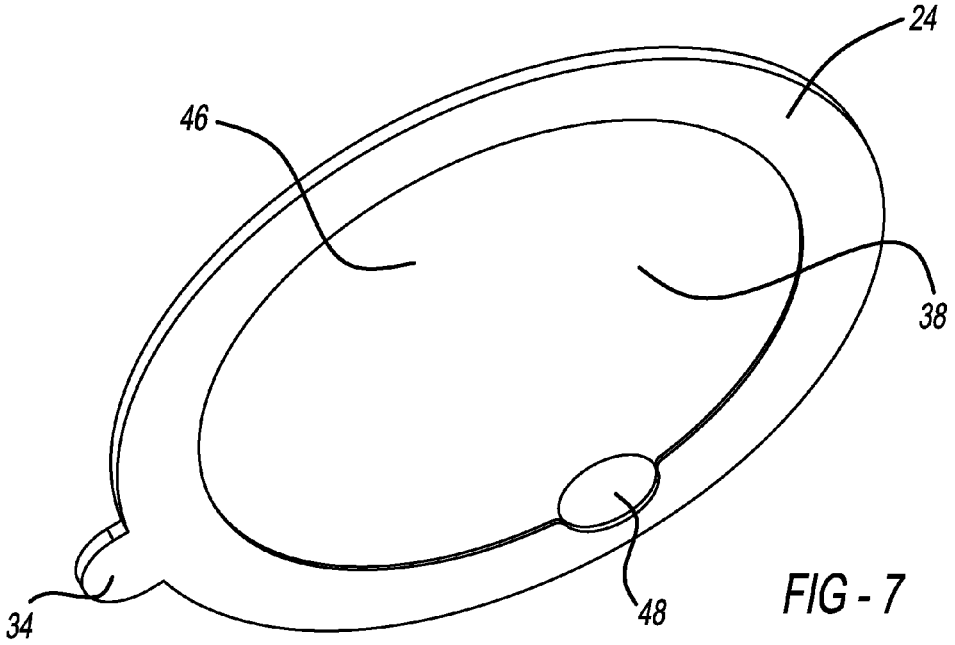
FIG. 7 illustrates a second side of the support base of FIG. 6.

Referring to FIGS. 6 and 7, a first side 36 and a second side 38 of the base plate 24 is shown. The first side 36 may include a cavity 40 for retaining an image, such as a photograph. The cavity 40 may be rectangular in nature or may be two rectangles laid on top of each other to allow different sizes of photographs to be utilized. Additionally, the first side 36 may include a first cutout 42 and even a second cutout 44 to allow easy removal of any image located within the cavity 38.

Referring to FIG. 7, the second side 38 of the base plate 24 may include a circular cavity 46. The circular cavity 46 also includes a cutout 48 to allow easy removal of a circular shape image from the cavity 46.

It should also be understood that an image may be permanently fixed to either the first side 36 or the second side 38 of the support base 24. For example, an image may be permanently printed on either the first side 36 or the second side 38 of the support base 24. Further, the cavity 40 or 46 may take any one of a number of different shapes to accommodate an image, such as a photograph.

As a person skilled in the art will readily appreciate, the above description is meant as an illustration of implementation of the principles this invention. This description is not intended to limit the scope or application of this invention in that the invention is susceptible to modification, variation and change, without departing from the spirit of this invention, as defined in the following claims.

The invention claimed is:

1. A vessel assembly for displaying an image comprising:

a vessel having a first side and a second side, wherein at least a portion of the vessel is at least partially transparent;

a plurality of brackets coupled to the second side of the vessel, the plurality of brackets being configured to stabilize the vessel on a surface;

the plurality of brackets being configured to detachably retain a support base to the vessel, wherein the support base is configured to retain an image between the support base and the second side of the vessel for allowing the image to be viewed though the portion of the vessel that is at least partially transparent;

wherein the plurality of brackets comprise a first bracket, a second bracket and a third bracket, wherein the first bracket, the second bracket and the third bracket are substantially equal distance from each other on the second side of the vessel;

an edging on the second side of the vessel, the edging extending between the first bracket and the second bracket and between the second bracket and the third bracket;

wherein the edging defines a substantially circular shape; and wherein the edging extends partially from the third bracket to the first bracket to define an opening between the edging and the first bracket.

2. The vessel assembly of claim 1, further comprising the support base.

3. The vessel assembly of claim 2, wherein the support base further comprises a first side and a second side, wherein the first side contains cavity for retaining the image.

4. The vessel assembly of claim 3, wherein the cavity further includes a cutout portion for allowing the image to be easily removed from the cavity.

5. The vessel assembly of claim 3, wherein the second side of the support base contains a second cavity for retaining the image.

6. The vessel assembly of claim 5, wherein the second cavity further includes a cutout portion for allowing the image to be easily removed from the second cavity.

7. The vessel assembly of claim 1, wherein the vessel is a plate or a bowl.

8. The vessel assembly of claim 1, wherein the first bracket, the second bracket and the third bracket are made of a semi rigid material for allowing removal or insertion of the support base.

9. The vessel assembly of claim 2, wherein the support base further comprises a handle, wherein the handle extends though the opening when the support base plate is retained by the plurality of brackets.

10. The vessel assembly of claim 9, wherein the handle of the support base is adjacent to the first bracket when the support base is retained by the plurality of brackets, wherein the handle extends though the opening when the support base is retained by the plurality of brackets.

11. The vessel assembly of claim 1, wherein the plurality of brackets are configured to retain the support base to the vessel and prevent rotation of the support base when the support base is retained by the brackets.

12. The vessel assembly of claim 2, wherein the support base is a rigid support base.

* * * * *